United States Patent [19]

Youtz et al.

[11] Patent Number: 4,791,258

[45] Date of Patent: Dec. 13, 1988

[54] SEALED ENCLOSURE FOR ELECTRICAL CIRCUITRY IN MOIST ENVIRONMENT

[75] Inventors: Stephen E. Youtz; Edward C. Rose, both of Fort Wayne, Ind.

[73] Assignee: Hamilton Standard Controls, Inc., Farmington, Conn.

[21] Appl. No.: 80,520

[22] Filed: Jul. 31, 1987

[51] Int. Cl.[4] ..... H01H 9/04

[52] U.S. Cl. ..... 200/302.1; 174/52.3; 200/5 A

[58] Field of Search ..... 200/302.1, 302.2, 306, 200/5 A; 174/52 S; 4/541, 542

[56] References Cited

U.S. PATENT DOCUMENTS 3,676,626 7/1972 Mitchell ..... 200/302.2

4,404,697 9/1983 Hatcher ..... 4/492

4,644,326 2/1987 Villalobos et al. ..... 200/302.2

*Primary Examiner*—Renee S. Luebke

[57] ABSTRACT

A sealed enclosure is provided for electrical circuitry to be located in a moist environment, as near a spa. The enclosure includes a housing of electrical insulating material, a display overlay adhesively bonded to the housing and covering certain openings in the housing for switches and displays, and a retaining bezel over the graphic overlay. Relief porting is provided in the bezel, and preferably also through a flange in a contiguous portion of the housing for assuring that water deposited on the display overlay will be drained away and thus not degrade the seal between the overlay and the housing.

7 Claims, 2 Drawing Sheets

SEALED ENCLOSURE FOR ELECTRICAL CIRCUITRY IN MOIST ENVIRONMENT

DESCRIPTION

1. Technical Field

The present invention relates to enclosures or housings for electrical circuitry and more particularly to a sealed enclosure for electrical circuitry for use in a moist or wet environment.

2. Background Art

In many instances, the mounting or housing of electrical circuitry requires relatively little concern for protection of humans from electrical shock, as because of remote location of the circuitry and/or because of the low electrical energy levels involved. However, in many other instances, the electrical energy levels and the potential for human contact therewith may be sufficiently great as to warrant suitable protection against such contact. There often is the further requirement that the electrical circuitry itself be protected from certain adverse environments. One example of the foregoing concerns arises with the provision of an input/-display unit associated with the control of a spa or swimming pool. Such input/display units may control water jets, blowers, timing functions, water temperature and/or lighting. Moreover, a display unit is helpful in indicating certain time and/or temperature parameters associated with the inputs. While certain types of low voltage and low current displays such as LED and LCD displays are available, they may not be satisfactory due to lighting or temperature conditions. On the other hand, a vacuum tube fluorescent (VF) display which overcomes these shortcomings requries substantially greater voltage and current. For instance, a suitable vacuum tube fluorescent display may require approximately 20 volts DC and draw 80 milliamps or more. Such energy levels, which may be even higher when the draw of the additional input circuitry is included, substantially exceeds an Underwriter's Laboratories (UL) requirement that products of this type not exceed 15 volts DC and 5 milliamp where they are within 5 feet of a wet location if there is possibility the control operator can make contact with the voltage and current.

SUMMARY OF THE INVENTION

Accordingly it is a principal object of the present invention to provide a sealed enclosure for electrical circuitry for use in a moist environment. Included in this object is the provision of a sealed enclosure which assures isolation and insulation between the electrical circuitry and possible human contact.

It is a further object of the present invention to provide a sealed enclosure for electrical circuitry associated with a spa control and intended for location and use in a moist environment, which enclosure is structured to resist degradation of the insulating barrier between a human operator and the electrical circuitry.

According to the invention, there is provided a sealed enclosure for electrical circuitry for use in a moist environment. The circuitry enclosure is particularly, though not exclusively, intended for use with the input/display for a spa control, particularly where that input/display is in a moist, or wet, environment and may be subjected to moisture-accumulating orientations. The enclosure is comprised of a housing means, a display overlay, and a retaining bezel having relief porting for draining moisture. The housing includes a cavity, or compartment, in which the electrical circuitry is mounted. The housing may be one, two, or more insulating pieces joined in relatively water-tight engagement. The housing includes an external display surface, and the interior compartment is open to that display surface over at least a limited portion of the display surface. The display overlay is of waterproof, electrically-insulating material and is in close sealed engagement with the housing display surface. The display overlay is sized to continuously cover that portion of the display surface which otherwise is open to the compartment containing the electrical circuitry. An annular bezel is fastened to the housing over the display overlay to aid in maintaining the overlay in position and prevent manual access to its edges. Relief porting is provided at least in the bezel for allowing moisture which may otherwise accumulate on the surface of the display overlay to be drained therefrom so as to inhibit degradation of the seal between the display overlay and the housing.

The housing preferably includes an annular flange to which the bezel is mounted, which annular flange further includes drain openings which act in cooperation with the relief porting in the bezel to drain moisture from the surface of the enclosure. The display overlay is preferably a transparent plastic material which is adhesively bonded to the housing display surface. The display overlay is sufficiently displaceable when mounted on the housing means to permit actuation of switches positioned thereunder upon manual depression of the display overlay.

BEST MODE FOR CARRYING OUT THE INVENTION

Figure 1:
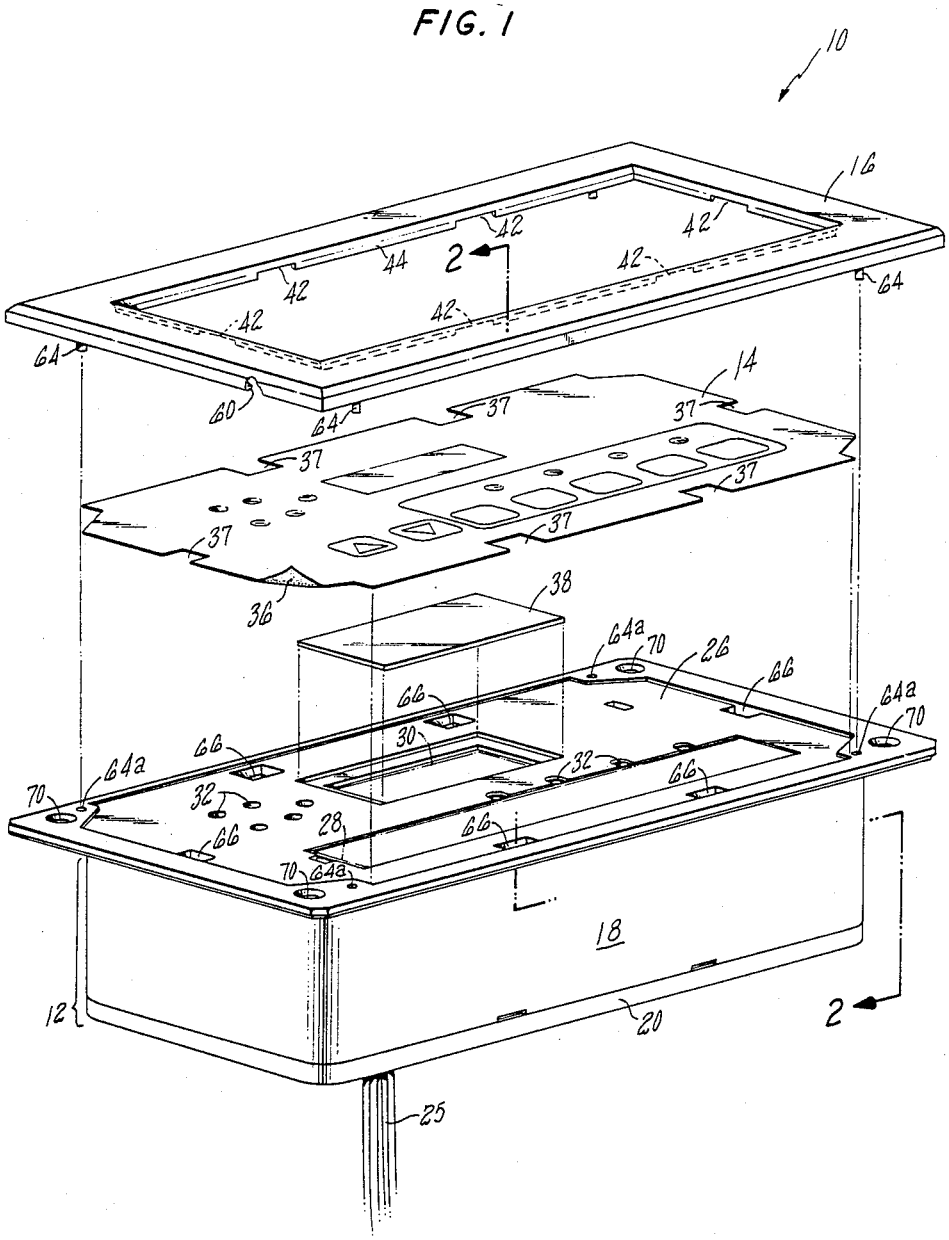
FIG. 1 is an exploded view of the sealed enclosure for electrical circuitry in accordance with the present invention.
Figure 2:
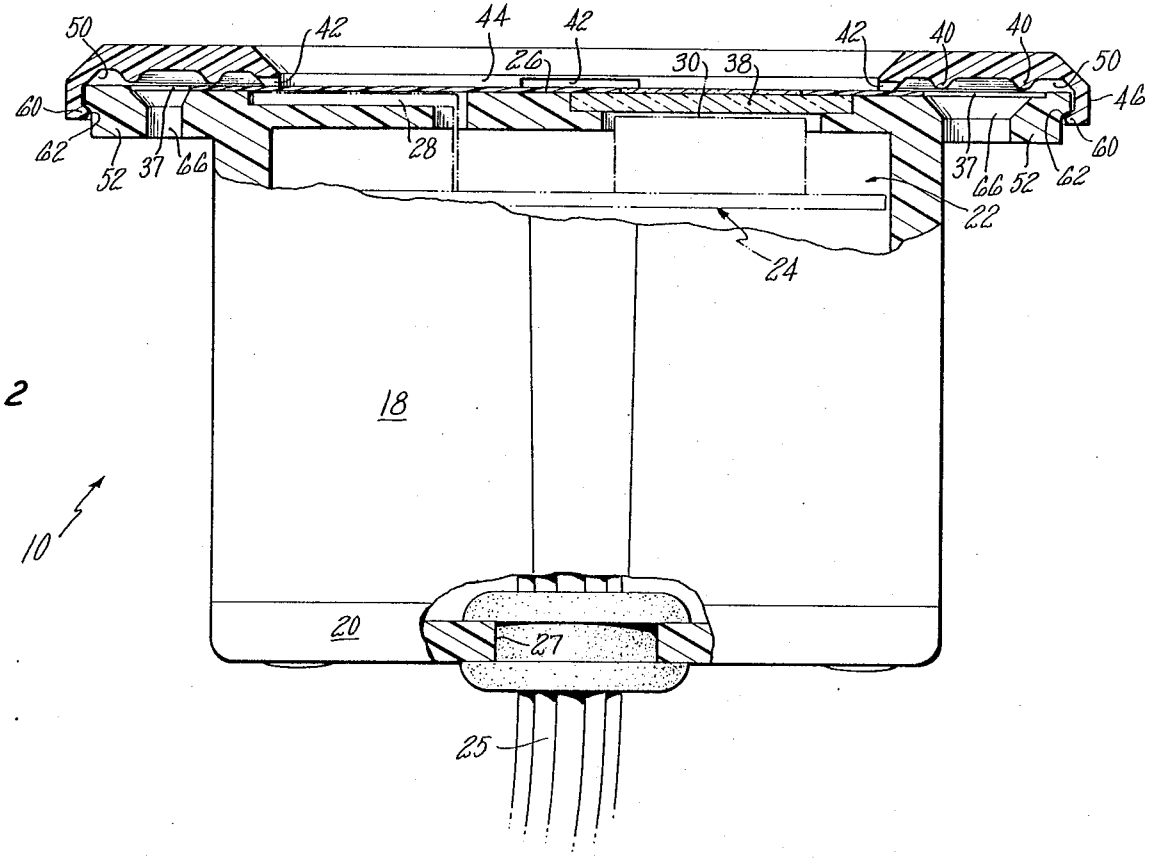
FIG. 2 is a sectional view of the circuitry enclosure of FIG. 1, partly broken away and partly in section, taken along line 2—2 thereof.

Referring to the drawings, the element of a sealed enclosure 10 are depicted in exploded form in FIG. 1 and in assembled form in sectional view of FIG. 2. The enclosure 10 includes a housing 12, a display overlay 14 and a retaining bezel 16.

The housing 12 is, in this instance, formed of two complementary portions, a top cover 18 and a bottom cover 20, each of durable, electrical insulating plastic having a thickness of at least 0.125 inch. The top cover 18 is formed to include a relatively large cavity, or compartment, 22 which houses the electrical circuitry 24 and some of the connecting wiring 25 (as seen in FIG. 2). The underside of the compartment 22 is sealingly closed by a sealing bond between the base of the top cover 18 and bottom cover 20, as with a silicone rubber sealant, and is maintained thus by suitable fasteners, such as screws. The wiring 25 passes in sealed relation through a grommeted opening 27 in bottom cover 20.

The top cover 18 includes a substantially flat display surface 26 at its upper end for presentation to the operator and upon which the display overlay 14 is mounted. The housing display surface 26 is continuous for much of its surface area to provide a waterproof, electrically-insulated barrier between the internal circuitry 24 and the external environment, which may include a human operator and excessive moisture. However, it is necessary to breach that barrier in certain locations to provide access to an input switch array 28, as well as to a vacuum tube fluorescent display 30 and several light emitting diodes (LEDS) which comprise part of the electrical circuitry 24 mounted within the compartment 22. These openings in display surface 26 for switches 28, display 30 and LEDS 32 would present an intolerable access to the electrical circuitry 24 within cavity 22 by both moisture and human contact unless sealed closed in the manner of the invention.

The display overlay 14 is a 0.020 inch thick piece of transparent polycarbonate material having the requisite graphics screened onto its undersurface and having a so-called "hardcoat" covering its upper surface for durability. Further, a coating of adhesive 36 covers the entire undersurface of the display overlay 14 except for those regions in registry with switches 28 and display 30. The adhesive 36 is not sensitive to the temperature changes and chemicals which might be encountered in the proximity of a spa, however, its adhesive properties may be degraded to some extent by the extended presence of water. In that regard, further provision is made in accordance with the invention to minimize the presence of standing water in the region of display overlay 14, as will be hereinafter described in greater detail. The display overlay 14 is of such area and geometry that it covers all of the openings in the housing display surface 26 that would otherwise provide access to the compartment 22. The outer perimeter of overlay 14 includes notches 37 at certain intervals, for a purpose to be explained.

A transparent rigid polycarbonate lens 38 may be positioned in a shallow recess in display surface 26 in registry with the display 30 to provide structural integrity to the top cover 18 in that region. The lens 38 may also contribute somewhat to the requisite isolation between the interior compartment 22 and the external environment.

The bezel 16 is of annular form for overlying the perimeter of the display overlay 14. Bezel 16 aids in retaining the display overlay 14 on the surface 26 of housing 12, particularly by denying casual access to the edges of overlay 14. The bezel 16 may also be provided with reinforcing ribs 40 (seen in FIG. 2) which contribute to its strength and may additionally aid in maintaining the overlay 14 in sealed engagement with the display surface 26 of the housing 12. Still further, the bezel 16 contributes to the aesthetics of the enclosure 10.

Unfortunately, however, the inclusion of the bezel 16 which extends outward, or upward, normal to the surface of display overlay 14, may serve to retain or trap moisture or water which is casually splashed onto the area of the display overlay 14. While the water might relatively easily run off of the enclosure 10 were it oriented such that the display overlay 14 extended in a vertical plane, the mounting of the enclosure is normally such that the display overlay faces upward and extends in a horizontal plane for ease of mounting and access. Therefore, in accordance with the invention, relief porting has been provided at least in the bezel 16 for allowing water to drain away by gravity from the surface of the display overlay 14 and ultimately be discarded.

The relief porting associated with bezel 16 includes a plurality of slots 42 spaced at intervals about the inner periphery of the bezel. Referring to the geometry of bezel 16 in greater detail, it will be noted that, in cross section as depicted in FIG. 2, the bezel comprises a shallow arch having a downwardly extending lip 44 at its inner perimeter, and a downwardly-extending lip 46 at its outer perimeter. The inner lip 44 engages the upper surface of the display overlay 14. The outer perimeter of bezel 16 is slightly greater than the outer perimeter of the display surface 26 of top cover 18, and the bezel lip 46 at its outer perimeter extends downward beyond surface 26 for snap-locked engagement with cover 18 as will be described in greater detail. Between the lips 44 and 46 at the inner and outer perimeters respectively of bezel 16, the bezel is relatively elevated from the surface of display overlay 14 to provide a channel, or passage, 50 in which water may flow. Though rows of ribs 40 extend longutidinally in the channel 50, those ribs are placed in a staggered arrangement which allows water flow around their ends. Additionally, the ribs 40 may be dimensioned such that they are spaced several thousandths of an inch above the surface of the display overlay 14. The porting slots 42 extend upwardly about 0.030 inch in lip 44 of the bezel 16. The slots 42 thus communicate with the cavity 50 formed outwardly thereof beneath the under surface of bezel 16.

The upper display surface 26 of top cover 18 extends laterally, or transversely, beyond the remaining walls of the cover so as to provide a flange 52 which defines the upper perimeter of top cover 18. The outer lip 46 of bezel 16 extends downwardly over the outer face of top cover flange 52 and includes a series of inwardly-extending snap-lock tabs 60 which engage a shallow lip 62 formed about the outer perimeter of the flange 52. The snap-lock arrangement between the snap-lock tabs 60 of bezel 16 and the lip 62 about flange 52 of top cover 18 serves to hold the bezel, and particularly inner lip 44 thereof, in engagement with the display overlay 14. Pilot pins 64 extend downwardly from each corner of the bezel 16 for insertion into complementary pilot openings **64*a* at the four corners of the display surface flange 52 to facilitate alignment of bezel 16** during assembly.

Although slots 42 in the inner perimeter of bezel 16 p ermit egress of water from the surface of display overlay 14 within that perimeter, that water then must be subsequently discharged from the cavity region 50 under the bezel 16. Bezel 16 might be provided with additional slots in the lip 46 about its outer perimeter, however, it has been found relatively more convenient and effective to provide drain openings 66 which extend vertically through the thickness of the top cover flange 52. The drain openings 66 extend through the flange outward of the vertical wall sections forming top cover 18 to facilitate discharge of water away from the enclosure 10. The upper entry to the drain openings 66 is chamfered to enlarge the surface area receiving the water from the slots 42. The drain openings 66 are generally in alignment with the slots 42 in bezel 16 but are positioned laterally outward thereof. Typically, each long side of the bezel 16 includes two slots 42 and the ends each include one slot 42. Further, the notches 37 at the edge of display overlay 14 are sized and positioned to be in registry with drain openings 66 to pass the water from slots 42.

To assemble the enclosure 10 to circuitry 24 is mounted in compartment 22 of cover 18, the electrical wiring 25 for circuitry 24 is led through the grommet-sealed opening 27 and bottom cover 20 is sealingly secured to top cover 18, lens 38 is positioned in the recessed seat in display surface 26 in registry with display 30, a release paper is removed from the adhesive backing on display overlay 14 and the overlay is adhesively sealed to the display surface 26 with the respective edge notches 37 in registry with the drain openings 66 in the display surface and the appropriate graphics aligned with the switch array 28 and display 30, and finally, the bezel 16 is snap-locked into engagement with the top cover 18 as previously described. The enclosure 10 may then be mounted in a horizontal position to a deck associated with a spa, as by threaded fasteners passing through mounting holes 70 in the flange 52 of top cover 18. The display overlay 14 is sufficiently displaceable to allow actuation of the displacement-type switches of array 28 in response to manual depression of the overlay.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to secure by Letters Patent of the United States is:

1. A sealed enclosure for electrical circuitry for use in a moist environment comprising:

housing means of waterproof material structured to include a compartment therewithin for containing electrical circuitry, the housing means comprising a substantially sealed enclosure having an external display surface, the compartment being open to the display surface over a limited portion of said display surface;

a display overlay of waterproof electrical insulating material, the display overlay being contoured for and being in, close sealed engagement with the housing means display surface and being sized to continuously cover said portion of said display surface open to the compartment;

an annular retaining bezel adapted for close mechanical engagement with the housing means, the display overlay being interposed between the bezel and the housing means display surface in retained sealed engagement with the housing means display surface; and wherein relief porting is included in at least said bezel for allowing moisture to naturally drain from the display overlay thereby to inhibit degradation of the sealed engagement of the display overlay with the housing means display surface.

2. The sealed enclosure of claim 1 wherein said display overlay has opposite inner and outer surface, the inner surface of the display overlay being in said engagement with said housing means display surface and said bezel extends normal to the outer surface of said display overlay, thereby creating a water barrier, said annular retaining bezel including an inner periphery and said porting comprises a plurality of aperture in the inner periphery of said bezel and juxtaposed with the outer surface of said display overlay for conducting moisture transversely beyond the inner periphery of said bezel.

3. The sealed enclosure of claim 2 wherein said relief porting is further included in said housing means display surface transversely outward of the inner periphery of said bezel and in communication with said bezel apertures for allowing moisture to drain.

4. The sealed enclosure of claim 3 wherein said housing means display surface extends transversely beyond the remainder of said housing means to form an annular support flange upon and to which the bezel is mounted and wherein said relief porting in said housing means display surface comprises drain openings extending through said support flange.

5. The sealed enclosure of claim 4 wherein at least a portion of said display overlay extends transversely outward a distance greater than a transversely inward limit to said drain openings in said support flange of said housing means, respective openings being provided through said display overlay in registry with said drain openings in said support flange to assure moisture drainage from said bezel apertures through said support flange drain openings.

6. The sealed enclosure of claim 2 wherein said display overlay is a transparent plastic material adhesively bonded to said housing means display surface.

7. The sealed enclosure of claim 6 wherein the electrical circuitry includes displacement-type switch means positioned substantially flush with said housing means display surface and wherein said display overlay is sufficiently displaceable to allow actuation of said switch means by manual depression of said display overlay.

* * * * *